US007571586B1

(12) United States Patent
Morales

(10) Patent No.: US 7,571,586 B1
(45) Date of Patent: Aug. 11, 2009

(54) METHOD AND APPARATUS FOR REFILLING A CONTAINER WITH A FLUID

(76) Inventor: Manuel A. Morales, 1354 Lucchetti St., Apt 6, San Juan, PR (US) 00907

( * ) Notice: Subject to any disclaimer, the term of this patent is extended or adjusted under 35 U.S.C. 154(b) by 0 days.

(21) Appl. No.: 12/060,515

(22) Filed: Apr. 1, 2008

(51) Int. Cl.
*B65B 55/24* (2006.01)

(52) U.S. Cl. ..... 53/167; 53/51; 53/267; 53/284.5

(58) Field of Classification Search ..... 53/425, 53/426, 467, 51, 67, 167, 267, 284.5; 194/208–212; 235/381, 383; 222/129, 129.1
See application file for complete search history.

(56) References Cited

U.S. PATENT DOCUMENTS 4,285,426 A * 8/1981 Cahill ..... 194/209
4,558,212 A * 12/1985 Hampson ..... 235/383
4,687,120 A * 8/1987 McMillin ..... 222/129.1
4,929,818 A * 5/1990 Bradbury et al. ..... 235/381
5,257,741 A * 11/1993 Rode et al. ..... 241/24.12
5,291,004 A * 3/1994 Frank et al. ..... 235/381
5,469,783 A * 11/1995 Fry ..... 100/49
5,566,732 A * 10/1996 Nelson ..... 222/129.1
5,612,525 A * 3/1997 Apter et al. ..... 235/383
5,699,162 A * 12/1997 Pirani et al. ..... 235/383

* cited by examiner

*Primary Examiner*—Louis K Huynh

(57) ABSTRACT

A method and apparatus for cleaning, sanitizing, and refilling reusable containers in order to reduce the non-biodegradable waste and environment contamination. The apparatus and process allows a person/consumer to refill the containers with any fluid dispensed by an apparatus such as a vending machine. The vending machine sanitizes the container before any fluid is dispensed into the container. Further, the machine provides the branding of the container depending on the consumer selection allowing people and consumer recognition of the product and enticing manufacturers to participate.

4 Claims, 8 Drawing Sheets

METHOD AND APPARATUS FOR REFILLING A CONTAINER WITH A FLUID

BACKGROUND OF THE INVENTION

1. Field of the Invention

The invention is related to a method and apparatus for refilling a container but more specifically to the identification, user interaction, and sanitizing of a container and refilling of fluid having short shelf life fluids.

2. Discussion of the Background

Lately people are concerned about the environment and are looking for ways to protect it. For example, in order to reduce the use of plastic waste, reusable containers are now utilized. U.S. Pat. No. 4,929,818 to Bradburry, discloses a method of vending a containerized product using multiple fillings of the same container. The method includes the steps of placing machine-readable indicia or means for reading on the container indicative of the price charged for both the container and the product contained therein, and at the time of placement of said indicia, or subsequently to such placement, including at a location adjacent to said indicia, a stimulus-responsive machine-readable indicator capable of responding to a stimulus to undergo a change of state which is readable, conjunctively with said indicia, by a machine, to indicate a price to be charged solely for the product in the refilled container. After initial vending of the container and the product, the container is refilled with product at least once, while concurrently, during each such refilling, stimulating said indicator to cause it to undergo said change, whereby the customer buying a refill of product is charged, on the basis of the subsequent machine reading, only for such product as is placed in the container during the refilling thereof. The container can be used for refilling multiple times, however the container is limited to only be filled with the same fluid or long lasting products. No cleaning or sanitation of the container is done in order to provide for fluids of short expiration time such as milk, juice and others.

Another example of environmental awareness is U.S. Pat. No. 6,578,763 to Brown, which discloses a method and apparatus for vending a containerized liquid product to a vendee, after an original liquid container has been emptied, by successive refilling of the product and utilizing machine-readable indicia on the container, a discount ticket or coupon being dispensed to the vendee upon completion of the filling of the container. The same principles of Bradburry apply here with the only difference that a vending machine will provide a discount ticket upon the completion of the container. Again the product is limited to the use of long lasting fluid, since no sanitation process is disclosed.

Therefore there is a need to provide a method and apparatus such as a vending machine for fluid refilling of fluid having a short shelf life. The present invention provides a vending machine that sanitizes the container as part of the refilling process in order to reduce and avoid the contamination of the refilled product.

SUMMARY OF THE INVENTION

The present invention provides a method and apparatus for refilling a reusable container in order to reduce the non-biodegradable waste and environment contamination. One of the invention's objects is to allow a person/consumer to refill the container with any fluid dispensed by said apparatus such as a vending machine.

Anther important aspect of the present invention is The sanitation of the container depending on the consumer fluid selection before any fluid is dispensed in it.

Further another important object of the invention is to provide a method for the branding of the container depending on the consumer selection allowing people and consumer recognition of the product and enticing manufacturers to participate.

Yet another aspect of the invention is to provide a container wherein the container is customizable and the identification means are physically protected.

BRIEF DESCRIPTION OF THE DRAWINGS

The accompanying drawings which are incorporated herein constitute part of the specifications and illustrate the preferred embodiment of the invention.

DESCRIPTION OF THE PREFERRED EMBODIMENT

The present invention overcomes all the disadvantages mentioned above by providing a method and apparatus for refilling a container with fluids having a short shelf life.

Figure 1:
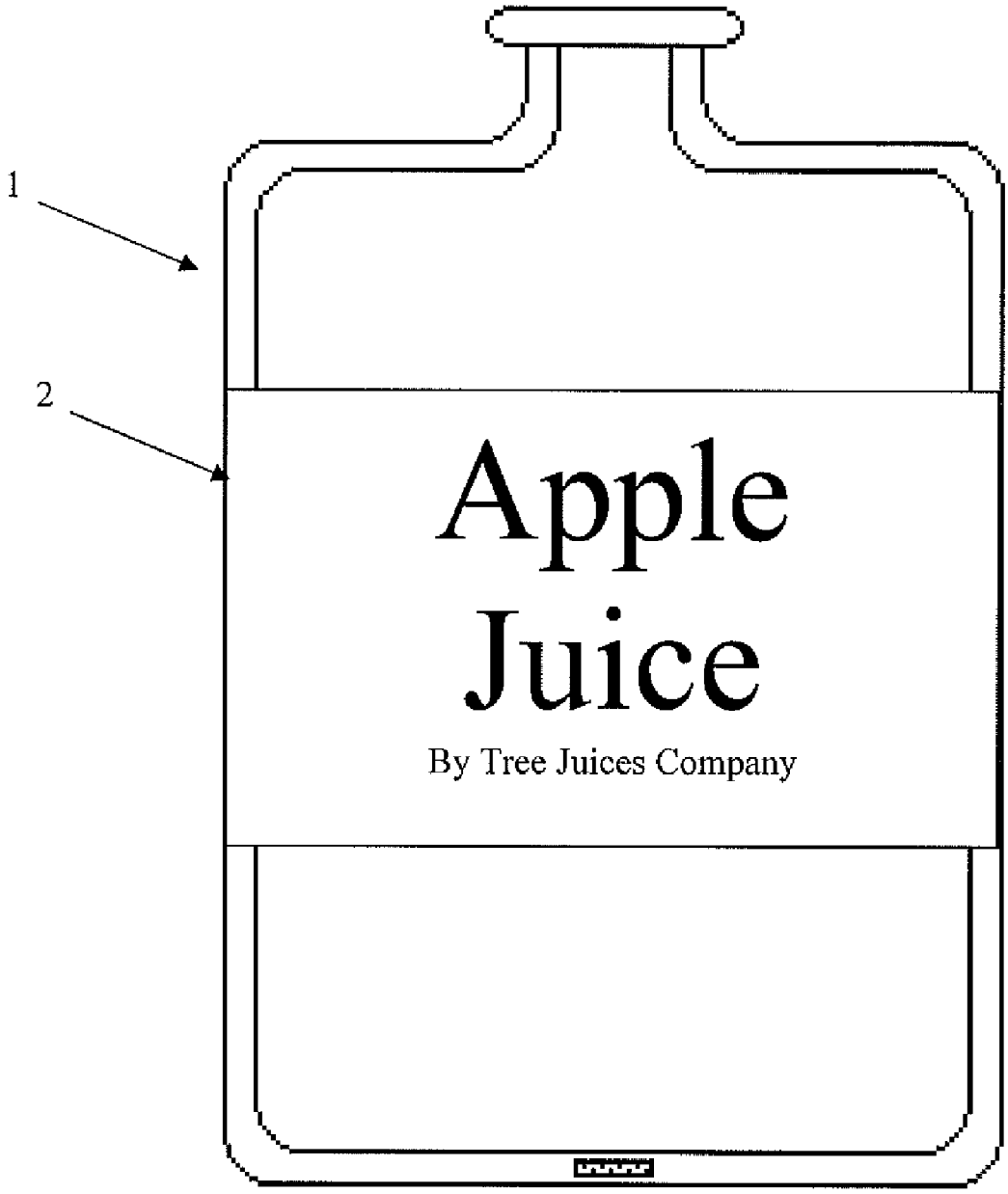
FIG. 1 shows the container.

The main components of the preferred embodiment are a container 1 and a vending machine 3. FIG. 1 shows the container 1 having a label 2 which is made of durable material, is easy to handle, capable of maintaining a certain temperature, should not exhibit carryover flavors and has readable means in order to acquire information or/and identify the container.

Figure 2A:
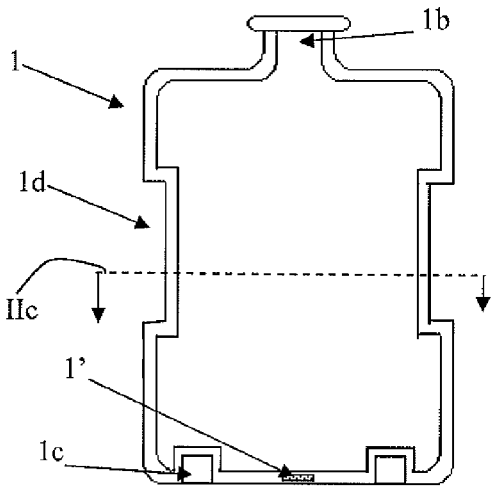
FIG. 2*a* shows the container preferred embodiment with chip.
Figure 2B:
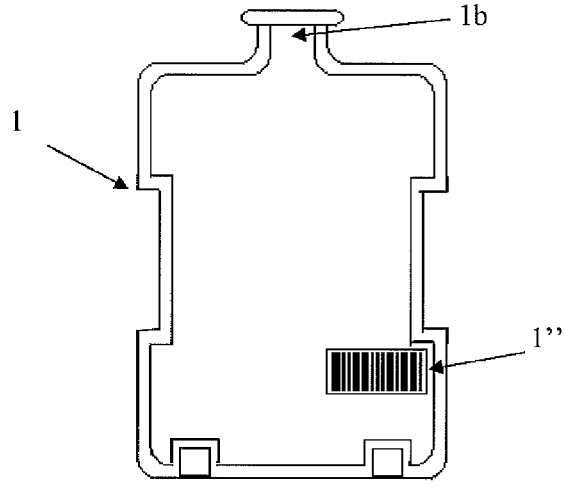
FIG. 2*b* shows the container preferred embodiment with bar code.
Figure 2C:
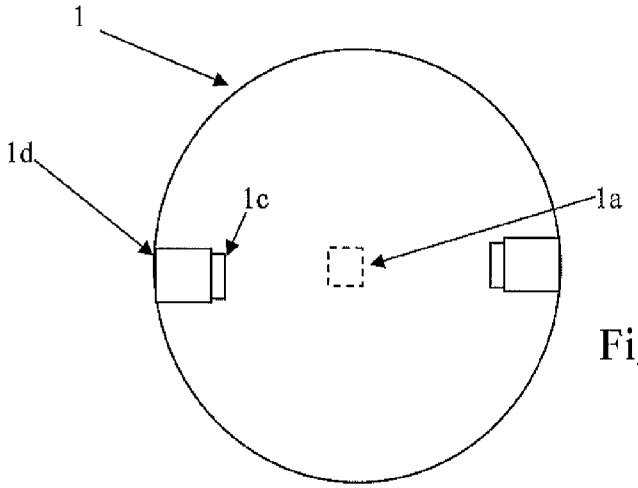
FIG. 2*c* shows an exploded view of section IIc from FIG. 2*a*

The container 1 is configured to interact with the vending machine 3 in such way that a smoother cleaning and refilling process is provided. FIGS. 2*a*-2*c* shows the preferred embodiment of the container 1 comprising readable means 1'-1", an opening 1*b*, lateral grooves 1*d* and bottom grooves 1*c*. The readable means 1', 1" are embedded in the container 1 structure in such way that it is protected from the environment. The container 1 readable means, such as a chip 1' or barcode 1", allows the apparatus to obtain usable information from a database. The readable information can be implemented through wireless RFID, wired connection by contact with the container's surface, infrared or optical communication with an electronic device inside the container, or barcode reading. The information obtained from readable means 1',1" or electronic identification includes, but is not limited to, consumer information, bottle information, production information, last fluid inside the container, etc. The container can be of several sizes, shapes and materials including, but not limited to plastic or any other material or combination of material that fulfills the limitations presented above.

As shown in FIG. 2*a* and FIG. 2*c*, the bottle has an RFID chip 1' as a readable mean placed at the bottom, protected by enclosing it inside the plastic or material substrate of the container 1. FIG. 2*b* shows an alternative for the readable means such as a barcode 1" placed inside the container 1 protecting said barcode 2*b* from scratches; however, it can be placed in any other part as long as it remains protected.

As mentioned before, the container 1' is provided with lateral grooves 1*d* and bottom grooves 1*c* used as engaging means for the vending machine in order to rotate or manage the movement of the container during the process.

Figure 3A:
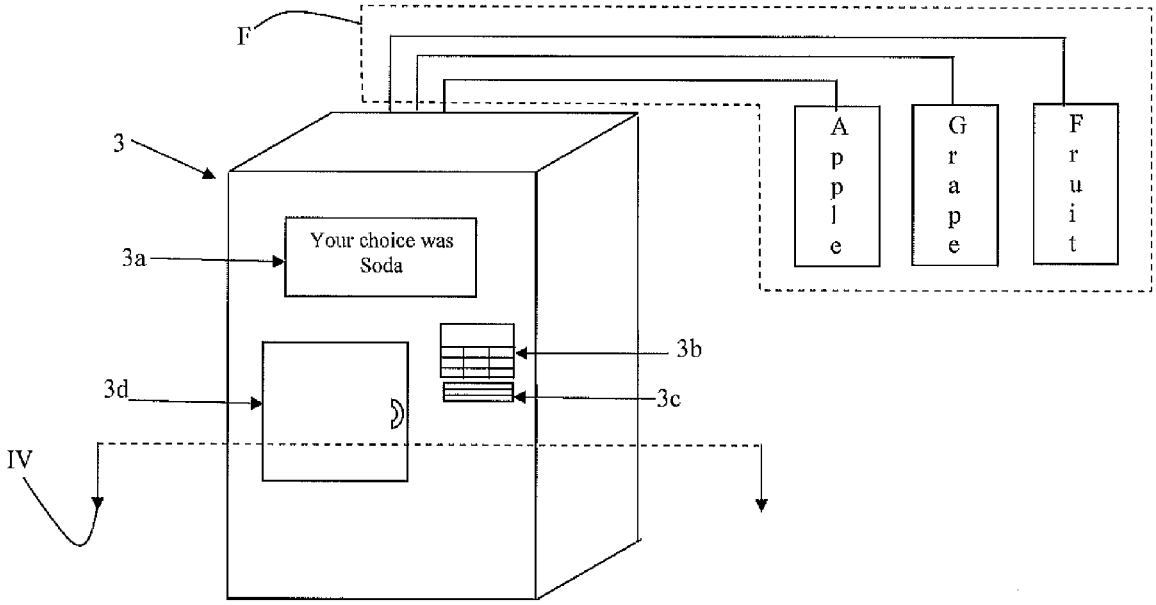
FIG. 3*a* shows a vending machine
Figure 3B:
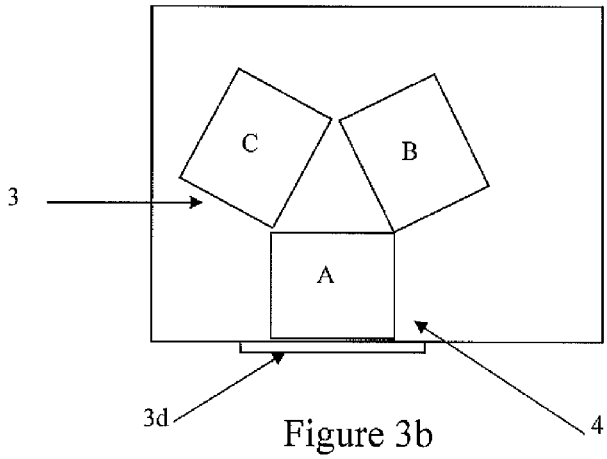
FIG. 3*b* shows a segmented vending machine chamber

The vending machine 3, as show in FIG. 3*a*-3*b*, is used to clean and refill the container 1 and comprises at least an opening 3*d* to the inner chamber 4, display 3*a*, information access mechanism 3*b* and/or a pay mechanism 3*c*. The vending machine 3 may contain inside of it the short life fluid or be connected to a fluids storage system F having a short shelf life. Also the vending machine 3 is provided with a container detection mechanism, cleaning, labeling and a refilling systems controlled by a computer. The container 1 with one or more sealable openings 1*d* is positioned inside the vending machine 3 through the opening 3*d* inside the chamber 4 for cleaning labeling and refilling. After the container 1 is positioned and the chamber door is closed., the process starts with a signal. In the instant case the starting signal is generated by a button outside the chamber located at the information access mechanism 3*b*. Mainly the cleaning and refilling process is as follows:

- Container is positioned and engaged inside the vending machine's chamber.
- Access and Acquire user information through the readable means and/or data base.
- Container label is removed
- Verify damages in the container
- Exchange of information with user
- Clean container
- Branding/Labeling
- Refill Container
- Seal container
- Edit and Store information regarding user, product and others.

The chamber 4, as shown in FIG. 3*b*, is divided in three main sections A, B and C, wherein certain steps are performed as part of the cleaning and refilling :process.

As mentioned above, first the container is positioned inside the chamber at section A in such way that protrusions 3*e* engage bottom grooves 1*c* and lock the container in position while controlling the rotation of the container 1. The vending machine opening 3*d* is closed and the start button is pressed in order to begin the cleaning and refilling process. At this point the container cap has been removed manually.

Figure 4:
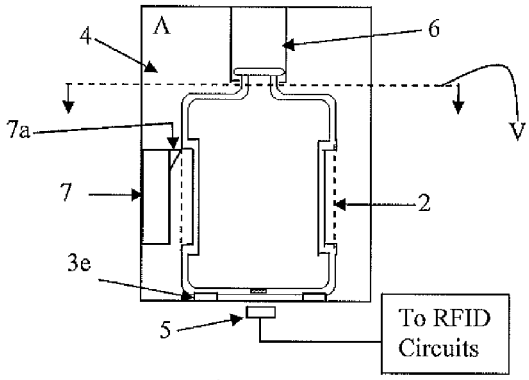
FIG. 4 container inside vending machine

The information at the readable means 1', 1" is accessed by means of a reader such as a RFID reader 5, as shown in FIG. 4, in order to identify the customer and acquire information from a database. The information obtained such as user personal information, fluid contained, credit card information and other is edited, used or stored for future reference. The information selected by customer is used, but not limited, to edit previous information, make a payment and refill the container with the new fluid.

The customer exchanges information with the database using the information access mechanism 3*b* in such way that the container is customized to identify the person/consumer and provide a quick menu for this customer based on the customer preferences. Also since the container 1 needs to be customized the user may then have to confirm or submit a PIN (personal identification number) or password which is related to the container for future refilling. In order to have customer information available for future refilling or any other uses or features, when the container is customized for the first time, information is requested from the user in order to provide the database with usable data such as payment method and preferences, including a submission of a PIN or password. Every time the container 1 is inserted in the machine's chamber 4 the machine will ask for the identity by personal identification number ("PIN") or some other means. In other words, a user profile can be created, which resides in the database located outside the machine 3 and is pulled up by placing the container in the machine, and can be used or altered after placing the PIN or password.

Figure 5A:
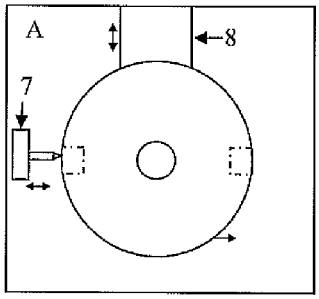
FIGS. 5*a*-5*c* shows the label detaching process
Figure 5B:
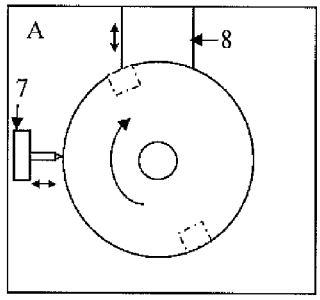
Figure 5C:
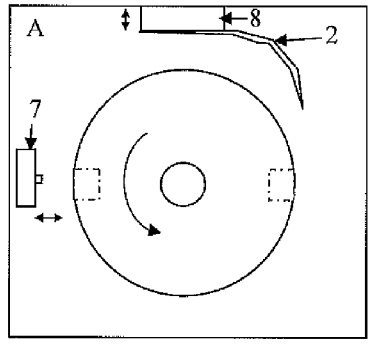
Figure 6:
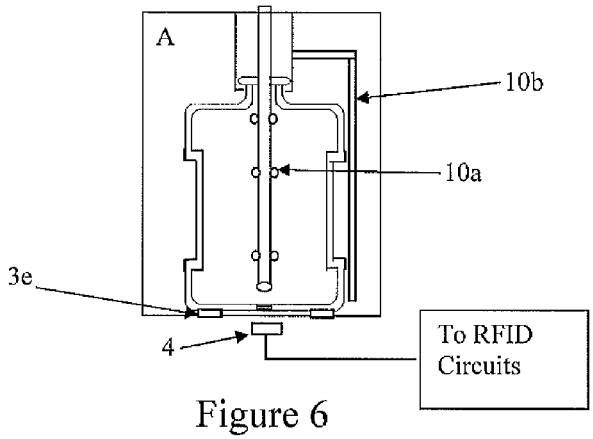
FIG. 6 show the container inspection process

It has to be understood that removing the label is necessary since the label needs to be updated in order to provide visible information for the customer such as the expiration date of the new fluid usually marked at the new label. The label can be removed and attached manually to the container 1, for example, using labels made of PVC Film or any other material which sticks to the container surfaces without any adhesive and removed without leaving behind any residue. The new label provided by the vending machine 3 after the payment and selection of the fluid is performed will display information such as but not limit to the brand, expiration date and nutrition facts. Another option is a vending machine 3 with a label detaching process which after the fluid selection and payment is performed removes the old label from the container's outer surface as shown in FIGS. 5*a*-5*c*. Cutting means 7 are used to remove the label, such as a razor or blade 7*a*. During the label detaching process a label remover 8 extends toward the container in order to contact the label at the container's surface. The cutting means 7 also extends towards the container but more specifically towards the lateral grooves 1*d*. The label is cut at the lateral grooves 1*d* area avoiding damages at the container 1 from the cutting process. The tension created by the label remover 8 makes the cutting process easier.

After the cutting is performed the container is rotated clockwise until the area pierced by the razor 7*a* reaches the label remover 8. Subsequently, the label remover 8 starts removing the label, for example, by suction while the container rotates in a counterclockwise direction. Next the label remover pulls back and the label detaching process is completed.

Before the container is refilled and to avoid the new fluid being spilled a container's damage inspection is performed. A light emitter 10*a* is inserted through the container opening 1*b* and a receiver 10*b* is positioned outside in order to receive the signal from the emitter and discern if the container is damaged. The receiver 10*b* may be static while the container rotates or the receiver may rotate while the container is static. As mentioned before the rotational motion of the container is controlled by protrusion 3*e*. If the container 1 is damaged the vending machine will finalize the process and an alert the customer. It has to be understood that in case the customer let the container with the cap on, the light emitter will remain outside the container and therefore the receiver 10*b* will recognize the container as damage.

Figure 7A:
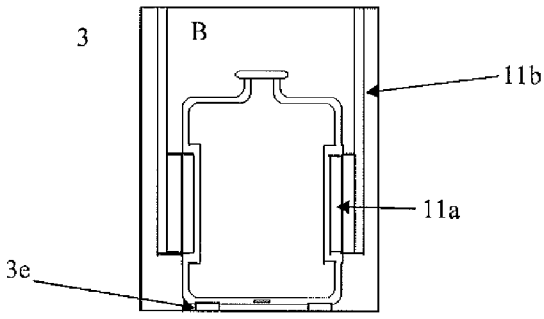
FIGS. 7*a*-7*b* shows container's cleaning process
Figure 7B:
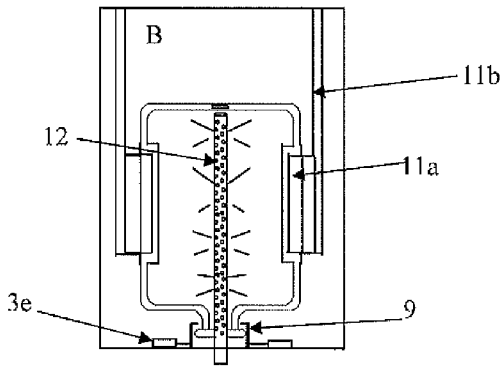
Figure 8A:
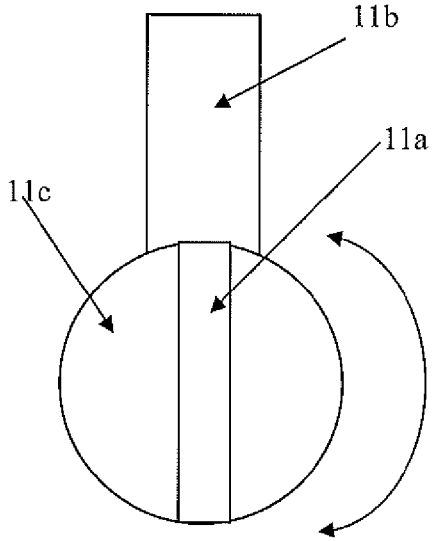
FIGS. 8*a*-8*b* shows vending machine locking arms
Figure 8B:
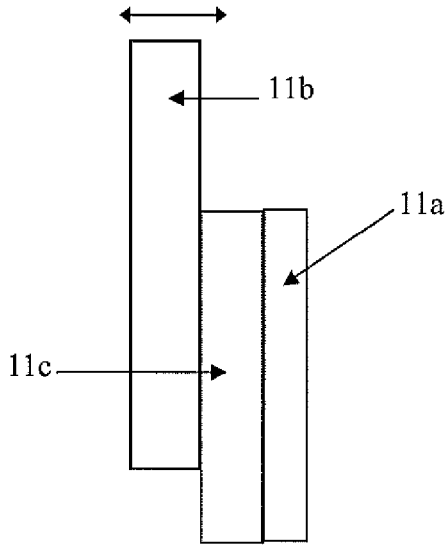
Figure 9:
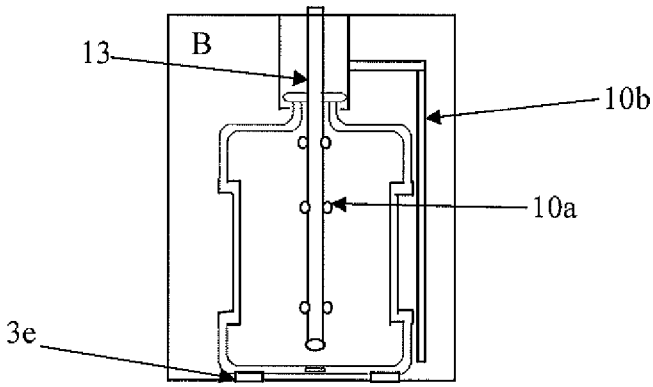
FIG. 9 shows container contamination revise

After the damage inspection is completed the container moves to the B stage wherein the cleaning process begins. In the instant case the cleaning process is performed by turning the container upside down. FIGS. 7*a*-7*b* show the use of two locking arms 11 in order to turn the container 1 upside down. Each arm extends parallel to the container, and comprises a vertical extension 11*b*, a rotational portion 11*c* and locking extension 11*a*. The locking extension 11*a* engages the lateral groove 1*d* and controls the upside down movement of the container 1. As shown in FIGS. 7*a*-7*b*, the vertical extensions 11*b* move vertically and horizontally in order to engage and control the container's movement. After the container is flipped upside down, a pipe is inserted through the containers opening 1*b*. A cleaning agent, such as vapor, hot water, soap or any other cleaning agent is applied to the containers inner walls through the pipe 12. A vacuum 9 connected at the container's opening 1*b* removes all the residues after applying the cleaning agent. Subsequently, as shown in FIG. 9, the container is turned to its original position and checked for contamination using a light emitter 10*a* device and a receiver 10*b*. If the receiver detects contamination the vending machine repeats the cleaning process for several times until the container is clean or a pre-determined number of tries is reached. If the number of tries is reached the vending machine 3 will finalize the process and alert the customer. The container may also have a material which may be altered to show graphics on the bottle, specifically brand names. The said material will be able to be cleared and altered in circumstances where the liquid used to refill is different from the previous liquid, or a new graphic or information is wanted or needed on the container.

Figure 10A:
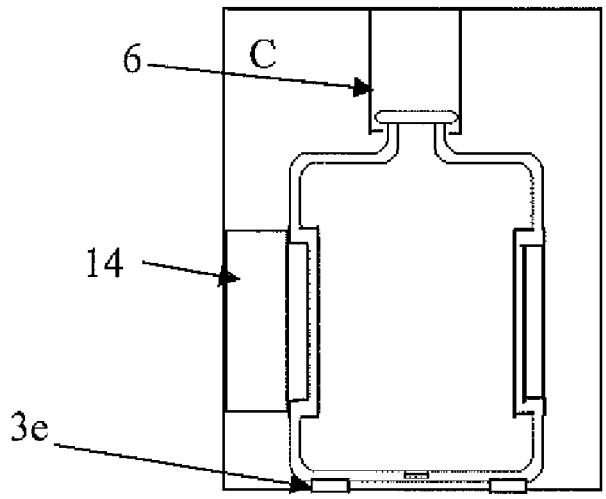
FIGS. 10*a*-10*b* shows labeling process
Figure 10B:
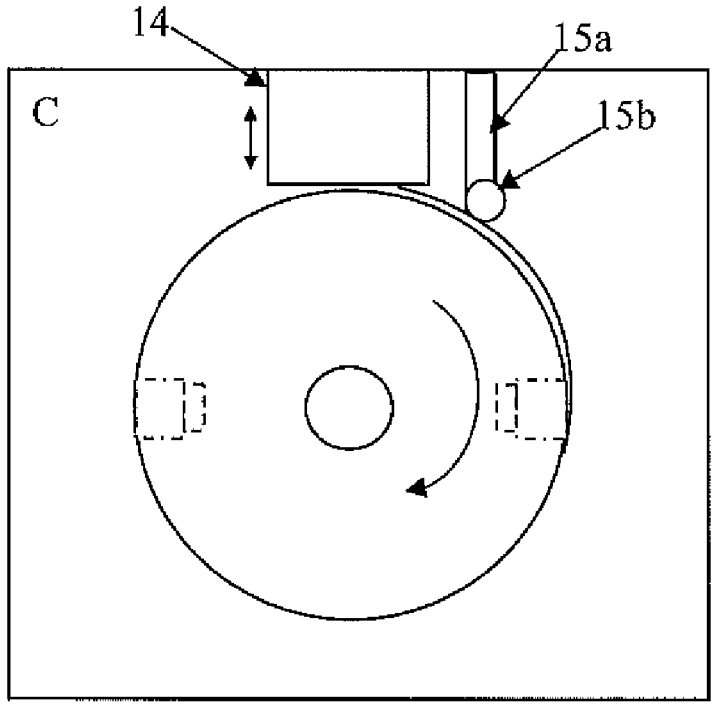
Figure 11:
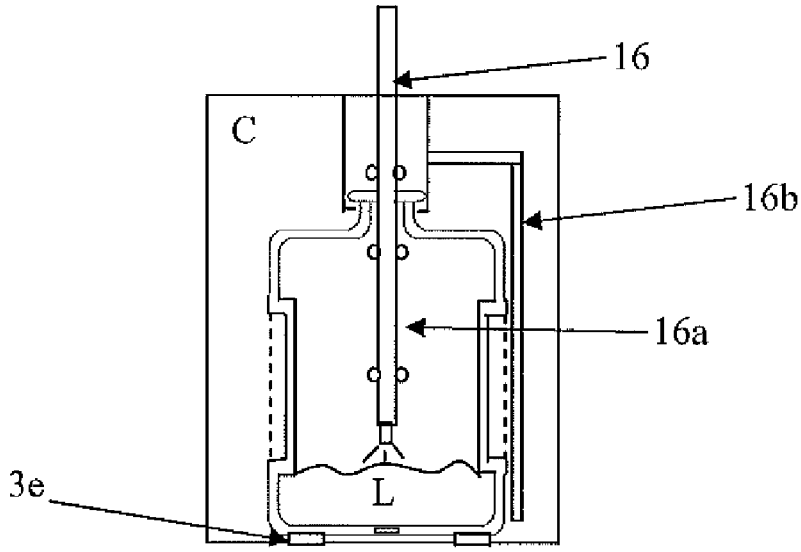
FIG. 11 show the refilling process
Figure 12:
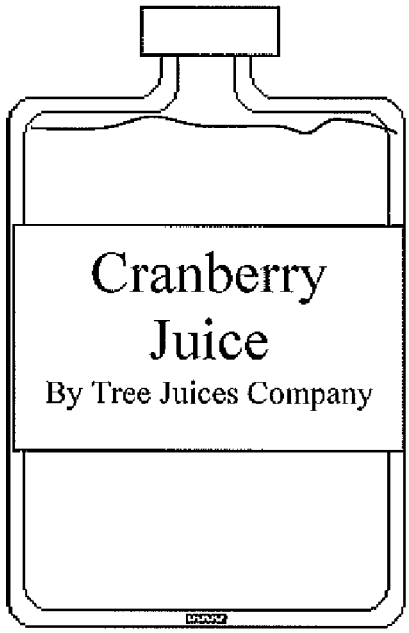
FIG. 12 shows container final product

The container moves to the next and final stage C wherein the container is labeled and refilled with the new fluid. FIGS. 10*a*-10*b* show the labeling process comprising a label provider 14 and a roller 15. The label provider 14 moves towards the container and applies the label of the product selected by the customer. The roller 15 also extends towards the container 1 and assists in the labeling of the container. After the labeling is completed the refilling process starts. FIG. 11 shows a pipe 16 inserted through the container's opening 1*b* and the new fluid L is served. The pipe 16 may be provided with level sensors. Next, as shown in FIG. 12, the container is closed, the information associated with the readable means 1', 1" is edited and stored and the customer is charged providing a reusable container with a new label and fluid. The vending machine will exhibit the product with a new label displaying information regarding the fluid and the new fluid ready for the customer.

While the invention has been described as having a preferred design, it is understood that many changes, modifications, variations and other uses and applications of the subject invention will, however, become apparent to those skilled in the art without materially departing from the novel teachings and advantages of this invention after consider this specification together with the accompanying drawings. Accordingly, all such changes, modifications, variations and other uses and applications which do not depart from the spirit and scope of the invention are deemed to be covered by this invention as defined in the following claims and their legal equivalents. In the claims, means-plus-function clauses, if any, are intended to cover the structures described herein as performing the recited function and not only structural equivalents but also equivalent structures.

All of the patents, patent applications, and publications recited herein, and in the Declaration attached hereto, if any, are hereby incorporated by reference as if set forth in their entirety herein. All, or substantially all, the components disclosed in such patents may be used in the embodiments of the present invention, as well as equivalents thereof. The details in the patents, patent applications, and publications incorporated by reference herein may be considered to be incorporable at applicant's option, into the claims during prosecution as further limitations in the claims to patentable distinguish any amended claims from any applied prior art.

The invention claimed is:

1. A sanitizing and fluid refilling system, comprising:

a plurality of containers each having at least one sealable opening, a set of lateral grooves, and a set of bottom grooves; wherein each container includes a label made of durable material and at least one readable means embedded in the container's structure to provide identifying information on the container's owner, the container, and the container's contents;

means for reading the at least one readable means;

a database that stores and provides information and instructions depending on the information obtained from the container's owner, the container's and its contents' identifying information; and at least one vending machine each comprising a vending machine opening leading to an inner chamber having at least three separate sections, a plurality of protrusions disposed in such way as to engage the set of bottom grooves and lock the container in place and control container's rotational motion wherein said container may be positioned inside the vending machine through said vending machine opening and wherein said container is configured to be locked in a pre-determined arrangement by using both sets of grooves as engaging means, with the vending machine limiting the undesired movement of said container, a display panel, an information access mechanism having a starting mechanism, a container detection mechanism, a damage inspection mechanism, a payment mechanism, a cleaning system, a refilling system, and a computer that controls said systems;

said damage inspection mechanism comprising a light emitter, a receiver disposed so as to receive a signal from the light emitter and discern if container is damaged, and an alert mechanism for finalizing process in case of damage;

said cleaning mechanism comprising a pair of locking arms each arm extending parallel to the container and comprising a vertical extension, a rotational portion, and a locking extension disposed so as to engage the lateral grooves and controlling the upside down movement of the container, each arm disposed so as to be able to turn container upside down, a pipe disposed so as to dispense a cleaning agent and water inside the container; a means to insert the pipe in the container; a vacuum for suctioning residues, a second light emitter; a second receiver; wherein said second light emitter and second receiver are disposed so as to detect whether container has been cleaned appropriately;

and said refilling mechanism comprising a second pipe for serving the fluid, level sensors, and closing means for sealing the filled container.

2. The system of claim 1 comprising;

a label removing system wherein said label removing system comprises cutting means disposed to remove a container's label, a container rotation means and a label removing means;

and a labeling mechanism wherein said labeling mechanism comprises a label provider, a roller and a means to print information on the labels.

3. The system of claim 1, wherein said means for reading readable means is selected from a group including: an RFID chip, a wired connection by contact with the container's surface, infrared or optical communication with an electronic device inside the container, and a barcode reader.

4. An apparatus for sanitizing and refilling a container as in claim 3, wherein said readable means is embedded in the container and protected from the environment.

* * * * *